United States Patent [19]

Lindgren

[11] 4,343,468

[45] Aug. 10, 1982

[54] HOCKEY STICK BLADE STRUCTURE

[76] Inventor: Wallace I. Lindgren, 4471 Ellerdale Rd., Minnetonka, Minn. 55343

[21] Appl. No.: 178,878

[22] Filed: Aug. 18, 1980

[51] Int. Cl.[3] ..... A63B 59/14

[52] U.S. Cl. ..... 273/67 A

[58] Field of Search ..... 273/67 R, 67 A, 78, 273/129 R, 129 P, 167 J, 173, 1 B

[56] References Cited

U.S. PATENT DOCUMENTS 870,041 11/1907 Lundberg ..... 273/129 P X

FOREIGN PATENT DOCUMENTS 15260 of 1904 United Kingdom ..... 273/78

23750 of 1905 United Kingdom ..... 273/78

23845 of 1906 United Kingdom ..... 273/78

15330 of 1914 United Kingdom ..... 273/78

*Primary Examiner*—Richard J. Apley

*Attorney, Agent, or Firm*—Leo Gregory

[57] ABSTRACT

The invention herein relates to the construction of the blade of a hockey stick wherein the blade embodies a replaceable resilient portion thereof to have such sufficient frictional engagement with the hockey puck as to provide a sufficient control of the puck for an accurate aim and an accurate line of travel and be useable for either a righthanded or lefthanded movement of the hockey stick.

10 Claims, 18 Drawing Figures

HOCKEY STICK BLADE STRUCTURE

BACKGROUND OF THE INVENTION

1. Field of Invention

This invention relates to the structure of the blade of a hockey stick.

2. Description of the Previous Art

The basic form of a hockey stick with rigid blade construction is well known and appears to have been relatively unchanged.

It is known that longitudinally curved blades are provided for handling a puck to overcome the tendency of the puck to slide off of the end of the blade. Such a structure of the blade makes it necessary to have separate hockey sticks for righthand and lefthand use, but even with such blade curvature there does not appear to be a desired degree of control of the puck.

SUMMARY OF THE INVENTION

It is the purpose of the invention herein to provide a hockey blade construction suitable for both right-handed and lefthanded use and which will provide improved control of the puck.

More specifically, it is the purpose and object of the invention herein to provide a blade structure for a hockey stick which will provide for such frictional engagement with a hockey puck as to permit sufficient control of the puck in aiming it to achieve the intended line of travel.

It is an object of the invention herein to provide a blade structure for a hockey stick which has a resilient body portion for either a righthand or lefthand operation and is such as to overcome the tendency of the puck to slide along the length of the blade and over the end of the blade in being moved along the ice and particularly to prevent the sliding movement of the puck along the blade as the puck is in the process of being aimed and shot.

It is another object of the invention herein to provide a blade structure for a hockey stick which embodies a resilient insert which yields sufficiently with engagement of a hockey puck to hold the puck in a given longitudinal position of the blade for accurate aim and drive of the puck.

More specifically, it is an object of the invention herein to provide a hockey blade structure comprising a planar member having an open bottom recess having a replaceable insert portion thereof, said insert portion being sufficiently resilient to yield upon engagement with a puck to flex and retain the puck for its positive control and for an accurate aim in shooting the puck to achieve the intended line of travel.

These and other objects and advantages of the invention will be set forth in the following description made in connection with the accompanying drawings in which like reference characters refer to similar parts throughout the several views.

DESCRIPTION OF PREFERRED EMBODIMENT

Figures 1, 2, 3, 4, 5, 6, 7, 8, 9:
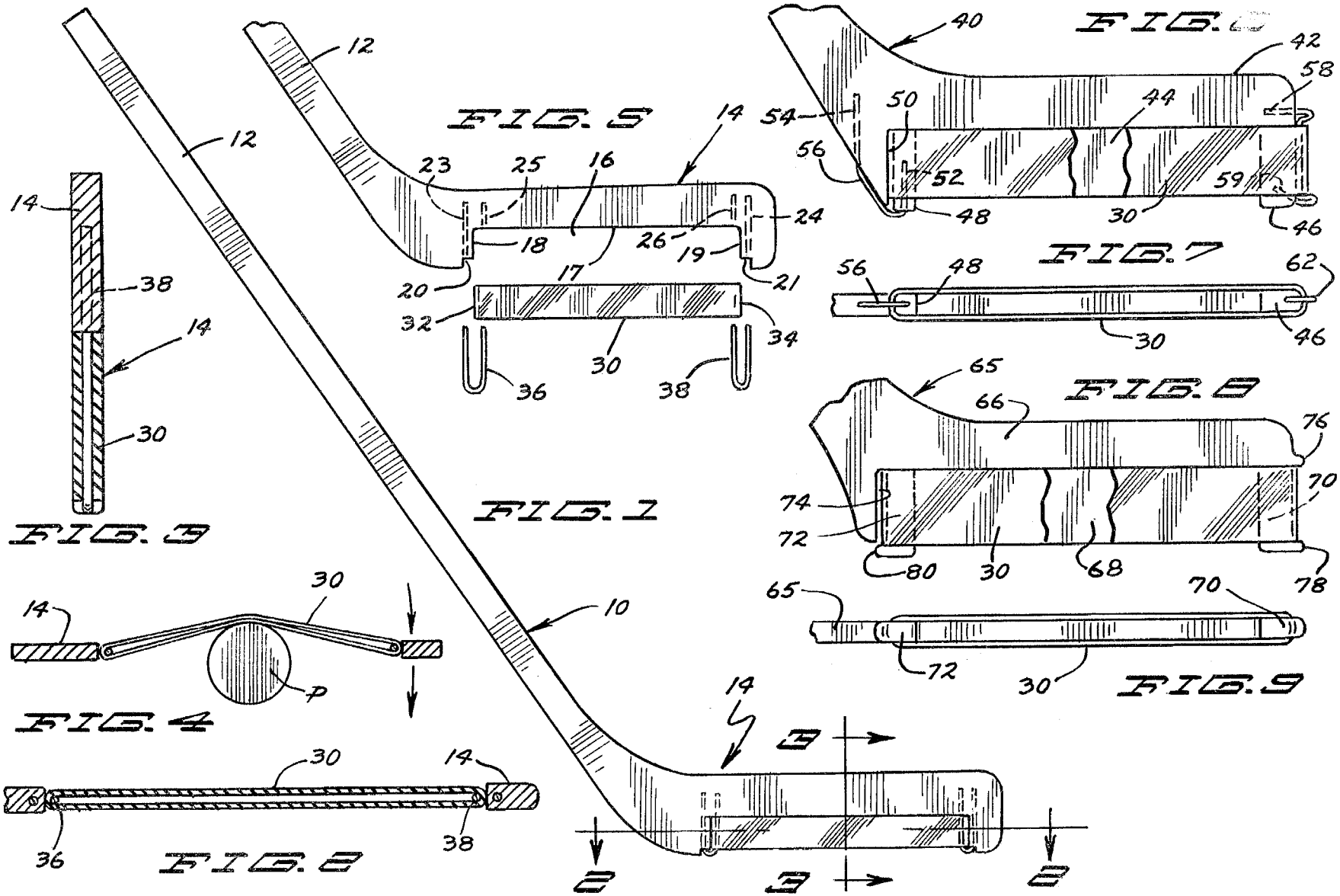
FIG. 1 is a view in side elevation.
FIG. 2 is a view in horizontal section taken on line 2—2 of FIG. 1 as indicated.
FIG. 3 is a view taken in vertical section taken on line 3—3 as indicated.
FIG. 4 is a view similar to that of FIG. 2 with a portion thereof in an alternate position.
FIG. 5 is a broken view showing a portion thereof in an exploded position.
FIG. 6 is a broken view in side elevation showing a modification.
FIG. 7 is a view of that shown in FIG. 6 in bottom plan.
FIG. 8 is a broken view in side elevation showing a modification.
FIG. 9 is a view showing that of FIG. 8 in bottom plan.

Referring to FIGS. 1–3, a hockey stick 10 is shown which embodies the invention herein.

Said hockey stick comprises a handle 12 and a blade 14, said handle blade having an integral construction in a conventional manner.

The structure of the blade 14 represents the novelty of the invention. Said blade has an open bottom cut out or recessed portion 16 as indicated, said recess having a top wall 17 and end walls 18 and 19 having lower stepped portions 20 and 21.

Said stepped portions are shown having upward vertically extending bores 23 and 24 with respective companion bores 25 and 26 extending inwardly vertically of said top wall and forming pairs with said bores 23 and 24.

An insert member 30 is disposed within said recess 16. Said insert member is suitably made of a tough yielding material which will yield sufficiently upon engagement with a hockey puck to flex somewhat and just sufficiently to overcome the tendency of the puck to slide off of the end of the blade and to be retained sufficiently for a positive control of the puck in moving it on ice and for accurate aiming and shooting purposes. Rubber or a rubber composition of a suitable durometer and suitable plastic materials may be used to form said insert member.

In the embodiment here described, said insert member is indicated as being formed of an endless strip of material having looped end portions 32 and 34 and having a height or width substantially that of the side walls 18 and 19 whereby its bottom will be above the plane of the bottom of said blade 14.

Removably holding said insert members in operating position are the U-shaped staple-like fasteners or retaining members 36 and 38. A leg of each fastener will be inserted within the loop and said fasteners are respectively disposed into and frictionally held within said pairs of bores 23-25 and 26-24.

In operation, the insert member 30 will be understood to flex or yield as indicated in FIG. 4 upon engagement with the puck P. Thus a sufficient pocket or recess is formed to overcome the tendency of the puck to slide off of the end of the blade in being moved on the ice in the play of the game and said pocket permits the operator to have sufficient control of the puck from its fairly contained position to have a good deal of accuracy in shooting it and to achieve an accurate line of drive in keeping with his aim in directing the puck.

Considerable accuracy is required on straight-in or head-on shots as well as with angle shots to direct the puck through a generally very small opening of the cage entrance which is not covered by the goal tender.

MODIFICATION

Referring to FIGS. 6 and 7, a modification of the above described structure is shown in which the blade portion 42 of the hockey stick 40 has a lower open bottom recessed portion 44 having a depending leg portion 46 forming its outer end portion. An inner leg portion 48 is formed spaced somewhat from the inner end portion 50 of said recess 44.

Adapted to be positioned about said leg portions 46 and 48 is the blade insert 30 above described having its ends looped about said leg portions as shown. Said insert is shown having a width less than the length of said leg portions.

Said leg portions 48 and the blade portion 42 have bores as at 52 and 54 to removably receive a staple-like retaining pin 56 to secure an end of said insert 30.

A horizontal pair of spaced bores 58 and 59 are formed inwardly of the outer end of said leg portion 46 with the base 59 being shown angled upwardly and said bores have a staple-like retaining pin 62 removably disposed therein.

MODIFICATION

Figure 10:
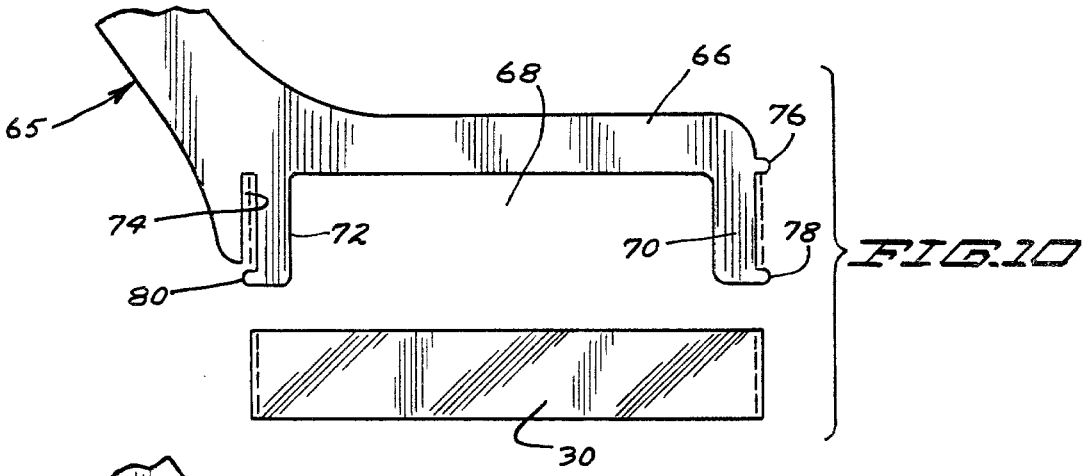
FIG. 10 is a broken composite view in side elevation in exploded position of FIG. 8.

A second modification is shown in FIGS. 8 through 10 in which a hockey stick 65 has a blade portion 66 having a lower open bottom recessed portion 68 therein having a leg portion 70 defining one end thereof and having a leg portion 72 spaced inwardly of the inner end wall 74 of said recess. Said leg portion 70 has small vertically spaced projections 76 and 78 outwardly endwise thereof and the leg portion 72 has a like lower projection 80.

The member 30 is disposed over said leg portions 70 and 72 and retained by said projections.

MODIFICATIONS

Figure 11:
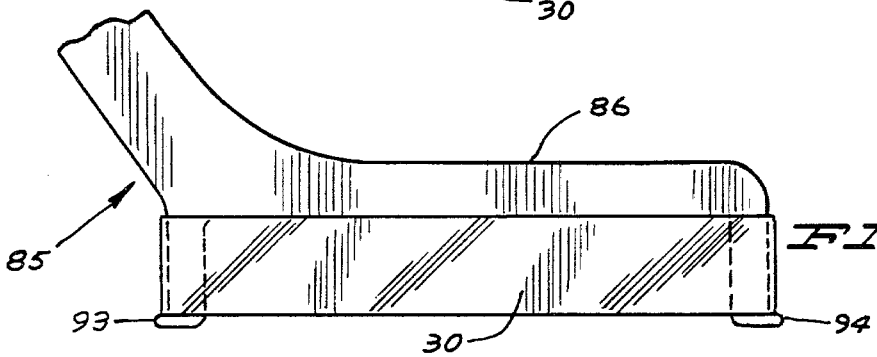
FIG. 11 is a broken view in side elevation showing a modification.
Figure 12:
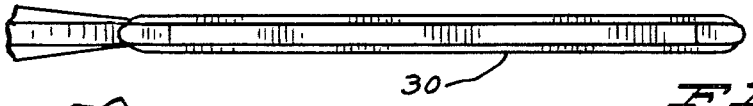
FIG. 12 is a view of that shown in FIG. 11 in bottom plan.
Figure 13:
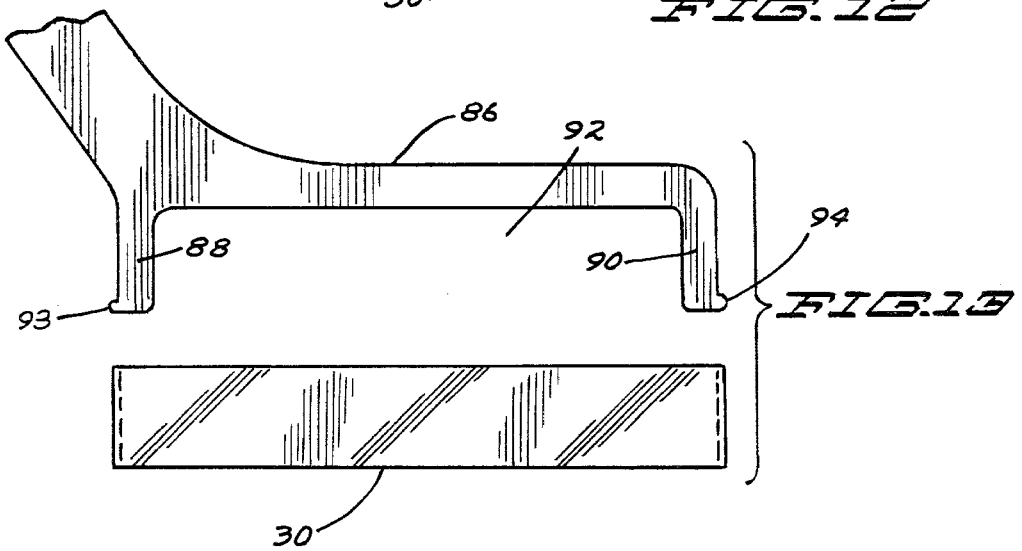
FIG. 13 is a broken view showing the structure of FIG. 11 in exploded position.
Figure 14:
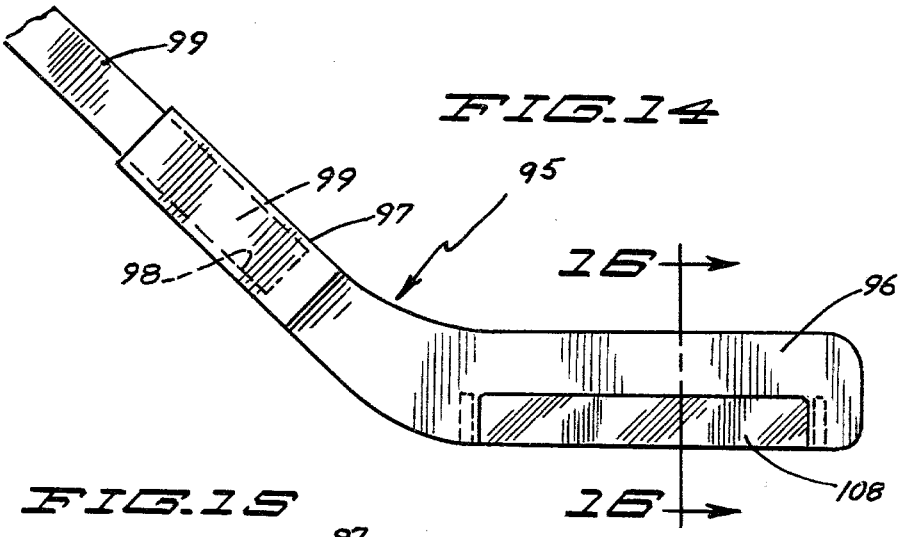
FIG. 14 is a broken view in side elevation showing a modification.
Figure 15:
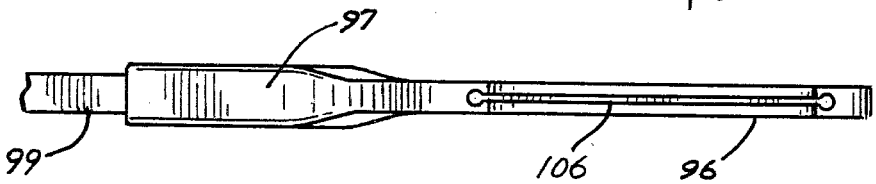
FIG. 15 is a broken view showing the structure of FIG. 14 in bottom plan.
Figure 16:
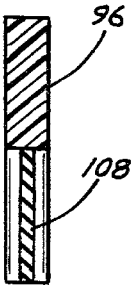
FIG. 16 is a view in vertical section taken on line 16—16 of FIG. 14.
Figure 17:
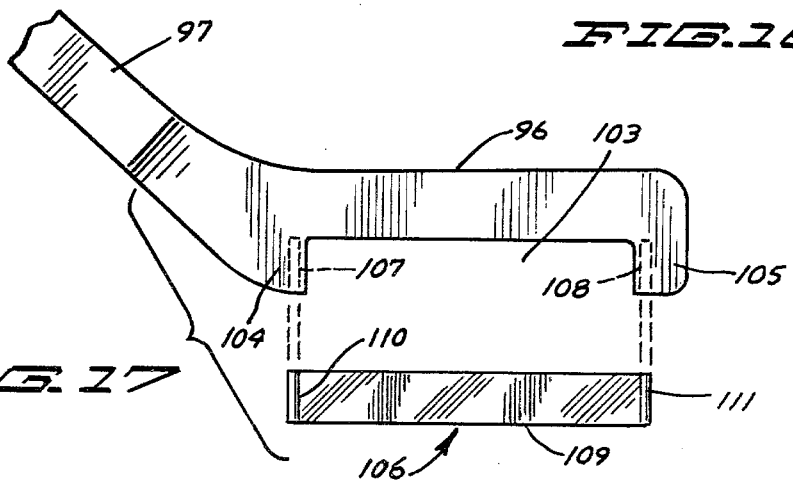
FIG. 17 is a broken view showing the view of FIG. 14 in exploded position.
Figure 18:
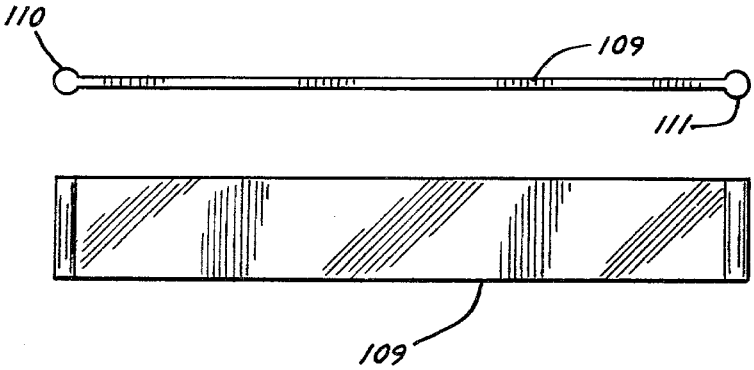
FIG. 18 is a composite view in bottom plan and side elevation showing a detail of structure.

A third modification is shown in FIGS. 11–13 in which the hockey stick 85 is shown having a blade portion 86 with said blade portion having depending leg portions 88 and 90 defining an open bottom recess 92 therebetween.

Said leg portions are shown having lower opposed end-wise projections 93 and 94.

Disposed over said leg portions 88 and 90 is the above described insert member 30.

MODIFICATION

A fourth modification is shown in FIGS. 14–18 in which a hockey stick 95 is shown having a blade member 96 having a throat portion 97 longitudinally slotted at 98 to receive therein the lower portion of a handle 99.

The blade portion 96 has a lower open bottom cut out recess 103 having end walls 104 and 105 which also form leg portions.

Said leg portions are shown having open ended slots 107 and 108 at their facing or opposed edges. An insert member 106 which differs from the member 30 in form only in having a solid body portion 109 with end portions 110 and 111 being substantially cylindrical projections to respectively be disposed into the open ended slots 107 and 108. The insert portion 109 is well shown in the composite view of FIG. 18 and is shown in operating position in FIG. 15.

In the above description of the insert members 30 and 106, they are shown as extending for substantially the full length of their respective blade portions. It is to be understood that within the scope of this member the length of the insert member is a matter of choice and it may extend over only one half or one third of the blade length, as may be desired.

The hockey stick as can be readily seen, has equal utility for left hand or right hand use. The insert member has just sufficient resilience to flex or yield when engaging a puck to give the operator more effective control over the handling of the puck than is deemed possible with prior art hockey sticks and such control that the operator may aim and shoot to achieve a desired line of drive or travel of the puck.

The insert members 30 and 106 in providing improved control of the puck provide substantial advantage to an operator in permitting him to have a better and more successful application of his skills in addressing the puck.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A hockey stick in which the improvement of the blade structure thereof consists of a planar blade member, said blade member having an open bottom open sided recess therein and having a top wall and end walls defining the extent of said recess, an insert member disposed within said recess and forming the entire wall thereof to the full extent thereof to act as the entire striking member, said insert member being sufficiently resilient to flex upon engagement with a hockey puck, and means carried by said blade member removably securing said insert member within said recess.

2. The structure set forth in claim 1, wherein said means comprises retaining members adapted to be removably disposed within said blade member adjacent each end wall defining said recess, and said retaining members respectively engaging adjacent end portions of said insert member to removably secure the same.

3. The structure set forth in claim 1, wherein said insert member forms a loop about said end walls, and said means comprises retaining pins disposed into said end walls and adjacent blade portions.

4. The structure set forth in claim 1, wherein said end wall members defining said recess respectively having vertically disposed slots in facing relationship, said insert member having end portions adapted to be removably received within said slots, and said means comprises retaining pins disposed into said end walls and adjacent portions of said blade.

5. The structure of claim 1, wherein said insert member is of single layered construction, the end portions of said insert member are enlarged in cross sections, and said means comprises retaining pins securing said end portions of said insert member to said end walls and adjacent blade portions.

6. The structure of claim 1, wherein said insert member is of a lesser height than the height of said recess.

7. The structure of claim 2, wherein said end walls each have a pair of spaced vertical bores, and said retaining members being disposed into said pairs of bores engaging and securing the respective ends of said insert member.

8. The structure of claim 1, wherein said end walls define leg members, and said means comprises projections of said leg members retaining said insert member.

9. The structure of claim 1, wherein one of said end walls forms a leg at the outer end of said blade member, a second leg member is spaced inwardly of said recess from the other of said end walls, and said means comprises retaining pins disposed into said leg members and the adjacent portions of said blade member.

10. The structure of claim 1, wherein said means comprises U-shaped retaining members, said insert member is adapted to receive said retaining members through its respective end portions, and said blade member has bores therein adjacent said end portions of said recess to receive said retaining members and secure said insert member.

* * * * *